US005402890A

United States Patent [19]

Yajima et al.

[11] Patent Number: 5,402,890

[45] Date of Patent: Apr. 4, 1995

[54] BOX CONTAINER FOR RIGID SHEET BODIES

[75] Inventors: Toshitsugu Yajima, Niigata; Yoshio Yoshida, Tokyo, both of Japan

[73] Assignee: Shin-Etsu Polymer Co., Ltd., Tokyo, Japan

[21] Appl. No.: 113,736

[22] Filed: Aug. 27, 1993

[30] Foreign Application Priority Data

Aug. 28, 1992 [JP] Japan ..... 4-066342 U
Jul. 27, 1993 [JP] Japan ..... 5-040857 U

[51] Int. Cl.[6] ..... B65D 85/48

[52] U.S. Cl. ..... 206/451; 206/560; 206/565

[58] Field of Search ..... 206/449, 454, 560, 565, 206/815, 334, 455, 451; 220/409, 410

[56] References Cited

U.S. PATENT DOCUMENTS

| | | | |
|---|---|---|---|
| 2,607,594 | 8/1952 | Rubinoff | 206/449 X |
| 2,914,189 | 11/1959 | Bishop et al. | 206/449 X |
| 3,532,213 | 10/1970 | Schulz et al. | 206/454 X |
| 3,612,337 | 10/1971 | Harger | 206/449 X |
| 4,869,368 | 9/1989 | Hara | 206/455 |
| 4,984,688 | 1/1991 | Mikulin | 206/455 |

*Primary Examiner*—Bryon P. Gehman
*Attorney, Agent, or Firm*—Henry T. Burke

[57] ABSTRACT

Proposed is a box container suitable for holding and transporting a plural number of sheet-like bodies such as lead frames for semiconductor devices such as ICs. The box container consists of three parts including (a) an inner box member to hold the sheet bodies, (b) a box tray member into which the inner box member is inserted and (c) a covering member to be engaged with the box tray member. The inner box member is an integral plastic body consisting of a generally rectangular base plate and side plates each connected, independently from the others, at the bottom line to one of the four sides of the base plate while each of the side plates is jointed to the base plate not perpendicularly but with outward inclination from the bottom to the upper periphery in such a resiliently bendable fashion that, when the inner box member is inserted into the box tray member, each side plate is contacted with the side wall of the box tray member with resilience to take a perpendicular disposition to ensure little play between the side plates and the sheet bodies therein while good working efficiency is ensured in putting and taking sheet bodies into and out of the inner box member.

9 Claims, 5 Drawing Sheets

BOX CONTAINER FOR RIGID SHEET BODIES

BACKGROUND OF THE INVENTION

The present invention relates to a structure of a box container for sheet bodies or, more particularly, to a novel structure of a box container useful for conservation and transportation of a plural number of precision-worked sheet-like bodies such as lead frames for semiconductor devices such as ICs.

Lead frames used for semiconductor devices and the like are prepared from a sheet of a metal by punching or etching and, when a plural number thereof are to be conserved or transported, they are stacked one on the other and wrapped together with a sheet of wrapping paper or put together into a plastic-made box container.

The above mentioned methods for the conservation and transportation of lead frames are no longer practical in view of the recent development of the devices such as ICs toward higher and higher degree of integration because the lead wire terminals thereof must be extremely fine and delicate. Namely, wrapping of frames with a paper sheet necessarily damages the extremely fine structure as a matter of course. When the lead frames are to be contained in a plastic-made box container, the play, i.e. a space for unimpeded movement of the lead frames within the container, cannot be too small because a too small play means a decreased working efficiency in putting and taking the lead frames into and out of the box container to increase the risk of deformation or damage of the lead frames unless an utmost care is taken although jolting of the lead flames during transportation can be decreased thereby and, when the play is too large, jolting of the lead frames during transportation is increased eventually resulting in the deformation of the lead wire terminals or contamination thereof by rubbing at the walls of the box container although the working efficiency can be improved in putting and taking the lead flames into and out of the box container.

SUMMARY OF THE INVENTION

The present invention accordingly has an object to provide a novel and improved box container for holding a plural number of precision-worked sheet-like bodies without the above mentioned problems and disadvantages in the conventional box containers even when the sheet-like body has a precision-worked, very delicate or fragile portion as is the case with lead frames.

Thus, the box container of the present invention for holding a plural number of precision-worked sheet bodies consists, as an assembly, of:

(a) an inner box member for holding the sheet bodies therein;

(b) a box tray member for holding the inner box member inserted thereinto; and (c) a covering member to be mounted to the upper periphery of the box tray member, the inner box member consisting of a generally rectangular base plate and a plural number of side plates each integrally connected at the bottom line thereof with one of the four sides of the generally rectangular base plate in such a fashion that, when the liner box member is standing free, each of the side plates is inclined outwardly from the bottom line to the upper periphery but is resiliently bendable to take an upright position when the same is pushed inwardly so that, when the inner box member is inserted into the box tray member, each of the side plates takes an approximately perpendicular disposition relative to the base plate by being in contact with the inner side wall of the box tray member.

DETAILED DESCRIPTION OF THE PREFERRED EMBODIMENTS

As is described above, the box container of the invention consists, as an assembly, of the three parts including (a) an inner or liner box member for holding the sheet bodies therein, (b) a box tray member for holding the inner box member therein and (c) a covering member to be mounted to the upper periphery of the box tray member while the most characteristic feature of the inventive box container consists in the unique configuration of the inner box member.

Figure 1A:
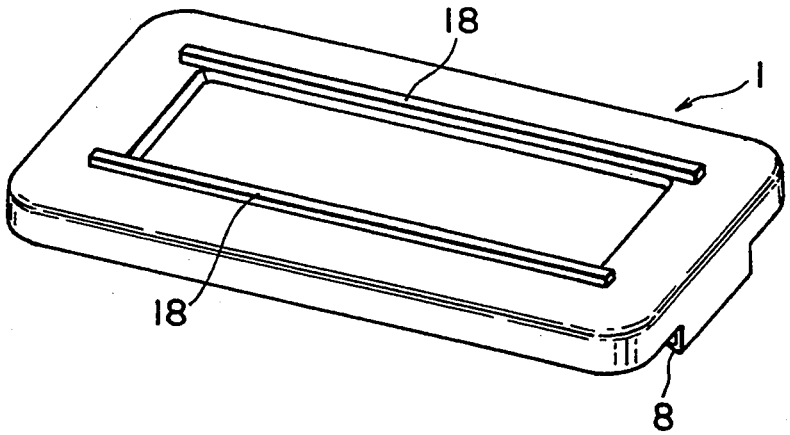
FIGS. 1*a*, 1*b* and 1*c* are each a perspective view of the covering member, inner box member and box tray member, respectively, in an embodiment of the inventive box container.
Figure 1B:
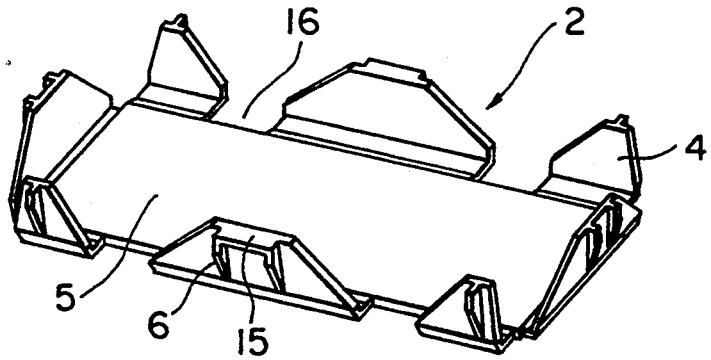
Figure 1C:
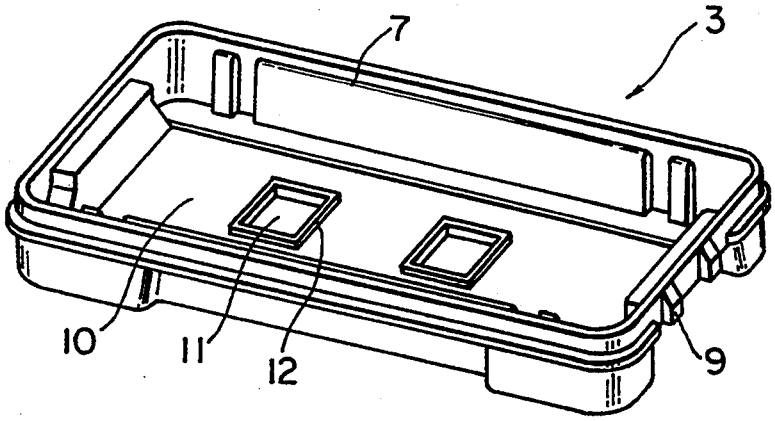
Figure 2A:
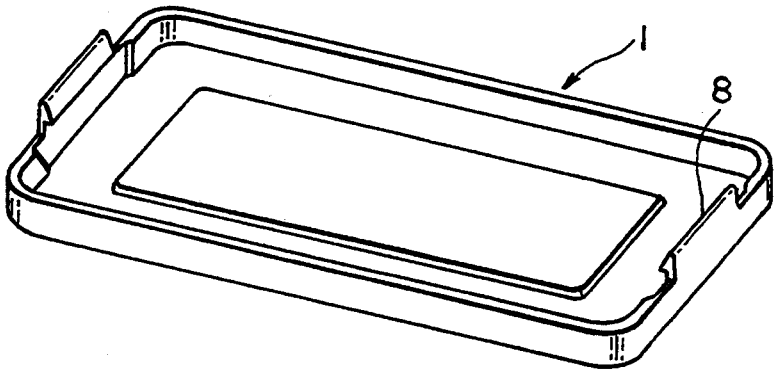
FIGS. 2*a*, 2*b* and 2*c* are each a perspective view of the same covering member, inner box member and box tray member, respectively, as in FIGS. 1*a* to 1*c*, each member being reversed upsidedown.
Figure 2B:
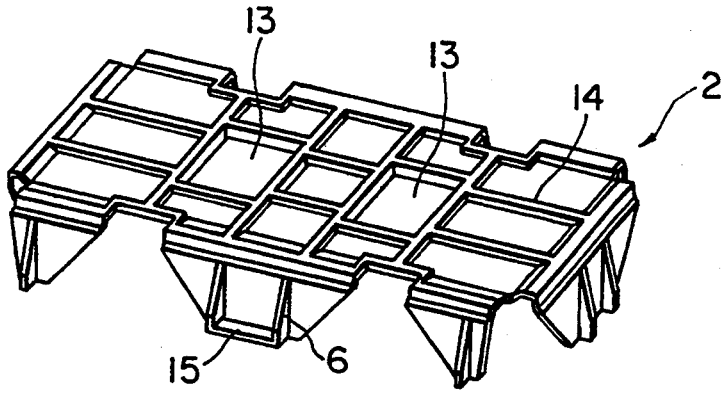
Figure 2C:
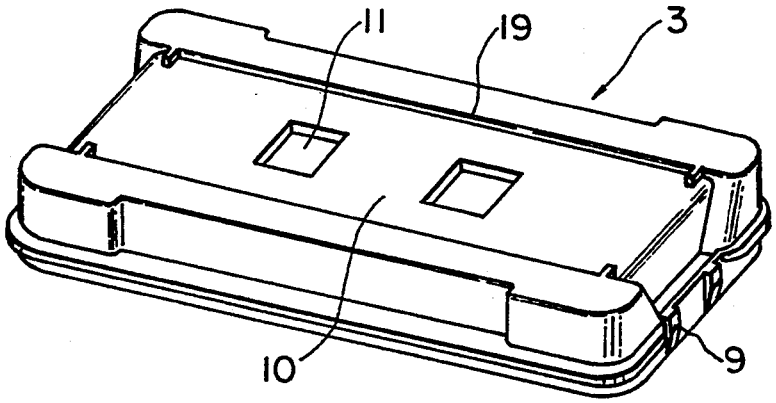

In the following, the box container of the present invention is illustrated in more detail by making reference to the accompanying drawing. FIGS. 1*a*, 1*b* and 1*c* each illustrate a perspective view of the covering member 1, inner box member 2 and box tray member 3, respectively, as viewed from above. FIGS. 2*a*, 2*b* and 2*c* each illustrate a perspective view of the same members as in FIGS. 1*a*, 1*b* and 1*c*, respectively, excepting reversal of each member upside-down. The inner box member 2 consists of the generally rectangular or square base plate 5 and a plural number of the side plates 4 each integrally connected at the bottom line thereof to one of the four sides of the generally rectangular base plate 5. It is important that the side plates 4 do not jointly form a single side wall of the inner box member 2 but each of the side plates 4 connected to one of the four sides of the base plate 5 is isolated from those connected to the adjacent sides of the base plate 5 by forming a notch therebetween so that each of the side plates 4 can be bendable inwardly with resilience independently from the other side plates 4 when it is pushed inwardly. It is optional that each of the side plates of the inner box 2 is divided into a plural number of the side plates 4 isolated each from the others by a notch 16 therebetween. As shown in FIG. 1*b*, each of the side plates along the longer side of the base plate 5 is divided into three side plates 4 by the two notches 16 therebetween while the side plates along the shorter side of the base plate 5 each consist of a single side plate 4. The position of the notches 16 is preferably selected in consideration of the efficiency, when the sheet bodies in the container are automatically trans-ported by a machine, in relation to the position of the arms of the handling machine to hold the sheet bodies.

It is important that each of the side plates 4 is integrally connected at the bottom line thereof with a side of the generally rectangular base plate 5 in such a fashion that, while, when the inner box member 2 is standing free without being inserted into the box tray member 3, each of the side plates 4 is not perpendicular to the base plate 5 but is inclined outwardly from the bottom line to the upper periphery, it is resiliently bendable inwardly when the side plate 4 is pushed inwardly until the side plate 4 is approximately perpendicular to the base plate 5. This biased bonding between the base plate 5 and the side plates 4 is illustrated in FIGS. 3*a* to 3*d* by a cross sectional view. As is shown in these figures, the side plate 4 is integrally connected to the base plate 5 not in a perpendicular disposition but in a disposition inclined outwardly by an angle of $\alpha$ as measured on the inner surface of the side plate 4.

Though optional, furthermore, each of the side plates 4 is provided on the outer surface thereof with a rib 6 (see FIGS. 1*b*, 2*b*, 3*a* and 3*b*) having a wedge-like side view with an increasing height from the bottom to the upper end making an angle $\beta$ relative to the inner surface of the side plate 4 so that the effective angle of inclination of the side plate 4 relative to the inner wall of the box tray member 3 is $\alpha+\beta$ to increase the reliability of holding of the liner box member 2 when it is inserted into the box tray member 3 by the contacting obtained between the inner surface of the side walls 7 of the box tray member 3 and the head of the rib 6. It is not always necessary that the wedge-like rib 6 covers the whole lateral length of the respective side plate 4 but it is sufficient that each side plate 4 is provided with a relatively narrow wedge-like rib 6 only at a portion of the outer surface thereof as is seen in FIGS. 1*b* and 2*b*. It is an advantageous design that a side plate 4 is provided with two wedge-like ribs 6 and these ribs 6 are connected with a horizontal rib 15, as is illusrated in FIGS. 1*b* and 2*b*, which serves as a hooking plate for the finger tips in putting and lifting the inner box member 2 into and out of the box tray member 3.

Figure 3A:
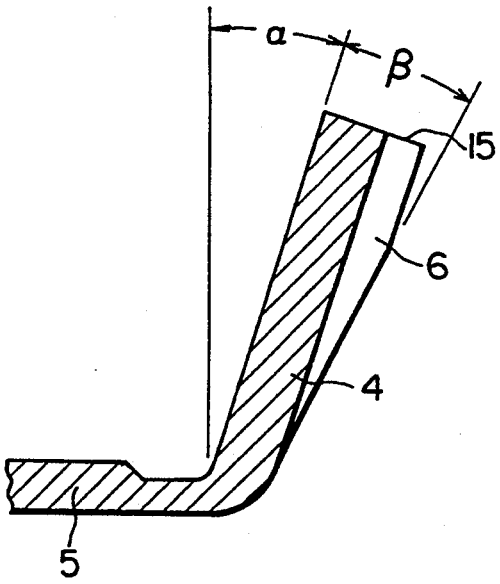
FIGS. 3*a*, 3*b*, 3*c* and 3*d* each illustrate, in one of four varied embodiments, a cross sectional view of one of the side plates connected to a side of the base plate of the inner box member of the inventive box container.
Figure 3B:
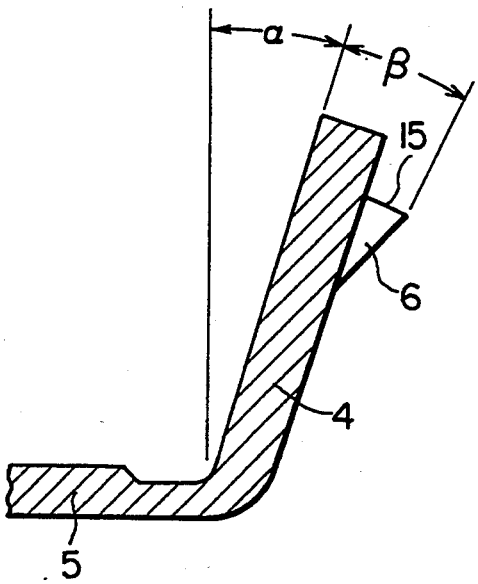
Figure 3C:
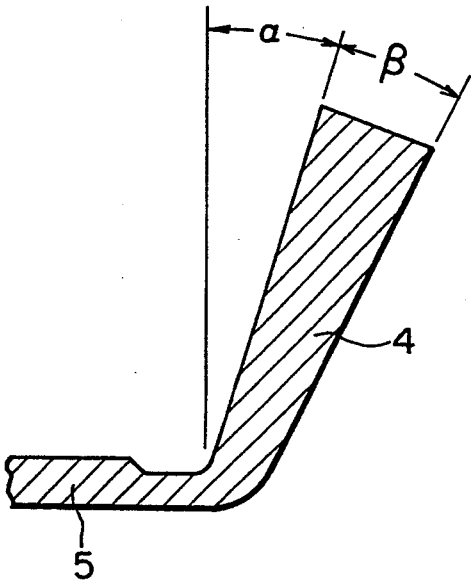
Figure 3D:
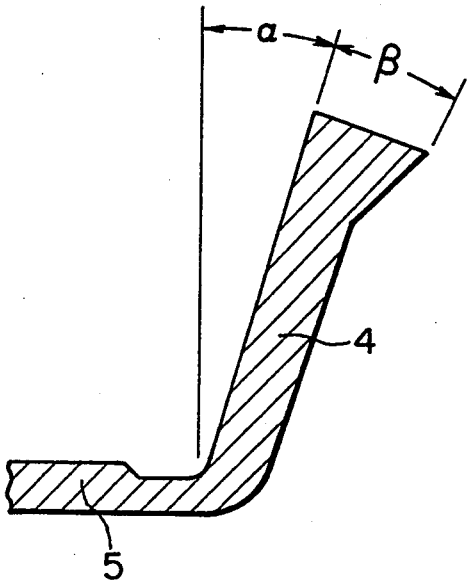

A similar effect can be obtained, instead of providing a wedge-like rib or ribs 6 on the outer surface of the side plate 4, by increasing the thickness of the side plate 4 from the lower end to the upper periphery as is illustrated in FIG. 3*c* or by having the upper end portion of the side plate 4 with an increased thickness as is illustrated in FIG. 3*d*. According to the detailed experimentation undertakern by the inventors, it is preferable that the angle $\alpha$ is in the range from 3° to 23° and the angle $\alpha+\beta$ is in the range from 6° to 46°. When the angle $\alpha+\beta$ is too small, the reliability of the holding effect of the inner box member 2 by the box tray member 3 is decreased while, when the angle $\alpha+\beta$ is too large, certain difficulties are encountered in the insertion of the inner box member 2 into the box tray member 3 due to a decrease in the slipperiness.

Though not particularly limitative, the inner box member 2 is shaped from a thermoplastic resin such as polyethylene resins, polypropylene resins, polystyrene resins, ABS resins, polycarbonate resins and the like in consideration of the requirement that the side plates 4 must be resiliently bendable relative to the base plate 5. In this regard, it is an advantageous design that the wall thickness of the liner box member is smaller along the connecting lines between the base plate 5 and the side plates 4 than in the other portions to be in the range from 0.1 to 4 mm or, preferably, from 0.2 to 3 mm or, more preferably, from 0.2 to 2 ram.

As is illustrated in FIGS. 1*c* and 2*c*, the box tray member 3, which consists of the base plate 10 and side walls 7 integrally formed by molding, is provided in the base plate 10 with one or more of windows 11 through which the inner box member 2 contained in the box tray member 3 can be pushed up by a finger tip when the inner box member 2 is to be taken out of the box tray member 3. It is of course a possible way that the inner box member 2 is pushed up through the windows 11 by means of an automatic pushing rods operated in a linkage motion with an automatic transportation machine which transports the lead frames contained in the container to a bonding machine and the like although it is not always necessary to take the inner box member 2 out of the box tray member 3. Though optional, the peripheries of the windows 11 are formed in the form of an inwardly raised frame-like form 12 by increasing the thickness. Corresponding to these windows 11 with flames 12, the bottom surface of the base plate 5 of the inner box member 2 is provided with recesses 13 (see FIG. 2*b*), into which, when the inner box member 2 and the box tray member 3 are assembled together, the frame 12 around the windows 11 in the base plate 10 of the box tray member 3 are fitted to make air-tight sealing in order to prevent intrusion of dust particles through the windows 11. It is a good design that the bottom surface of the base plate 5 of the inner box member 2 is provided with down and across ribs 14 in order to increase rigidity and to prevent warping of the base plate 5.

Figure 4A:
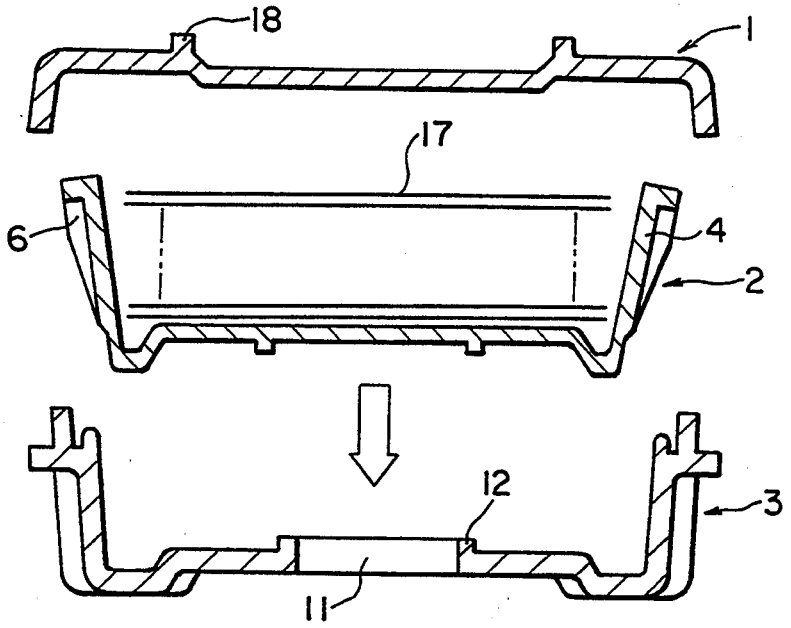
FIGS. 4*a*, 4*b* and 4*c* each illustrate one of the steps for the assemblage of the covering member, inner box member holding the sheet bodies and box tray member in the inventive box container by a cross sectional view.
Figure 4B:
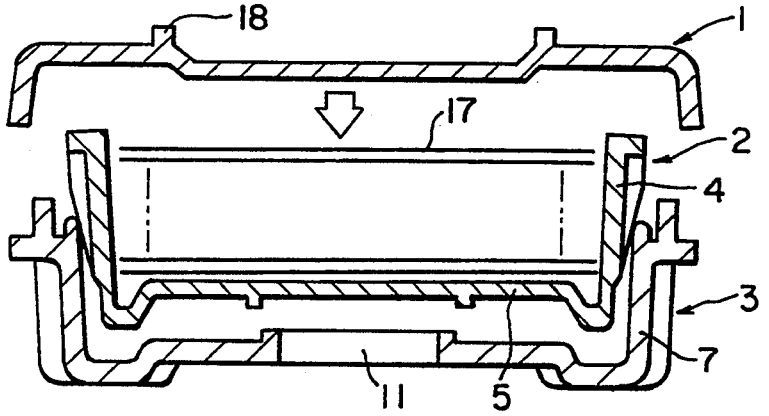
Figure 4C:
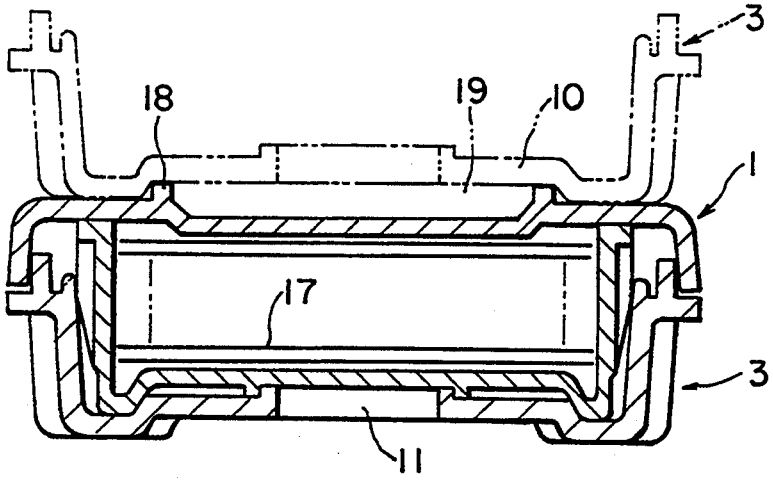

FIGS. 4*a* to 4*c* illustrate the steps for putting a plural number of sheet bodies 17 such as lead frames into the box container of the present invention each by a cross sectional view. As is illustrated in FIG. 1*a*, firstly, a plural number of the sheet bodies 17 are laid one on the other in the liner box member 2 standing free. Since the side plates 4 of the inner box member 2 are each inclined outwardly, good working efficiency can be ensured in putting the sheet bodies 17 thereinto not only by a manual work but also with an automatized machine without the risk of damaging the sheet bodies. In the next place, as is illustrated in FIG. 4*b*, the inner box member 2 mounting the sheet bodies 17 is inserted into the box tray member 3 so that each of the side plates 4 of the inner box member 2 is contacted at the upper portion thereof with the inner surface of the side wall 7 of the box tray member 3 to be pushed and bent inwardly until the inner surface of the side plates 4 is approximately perpendicular to the base plate 5 so as to hold the sheet bodies 17 with a sufficiently small play not to cause jolting of the sheet bodies 17 in the inner box member 2 under transportation. Lastly, as is illustrated in FIG. 4*c*, the covering member 1 is put on the box tray member 3 to air-tightly fit at the upper periphery thereof. The covering member 1 is provided at opposite positions with hooks 8 which come into engagement with the hooks 9 on the side walls of the box tray member 3 so as to ensure fixing of the covering member 1 to the box tray member 3.

When a plural number of the inventive box containers are stacked one on the other, it is a good design that the covering member i is provided on the upper surface with ribs 18 and, corresponding thereto, the base plate 10 of the box tray member 3 is provided on the bottom surface of the base plate 10 with a recess 19 so that, when a box container is put on the other, the ribs 18 on the covering member 1 of the lower box container just fit the recess 19 in the base plate 10 of the upper box container to prevent the upper box container from slipping down.

Figure 5:
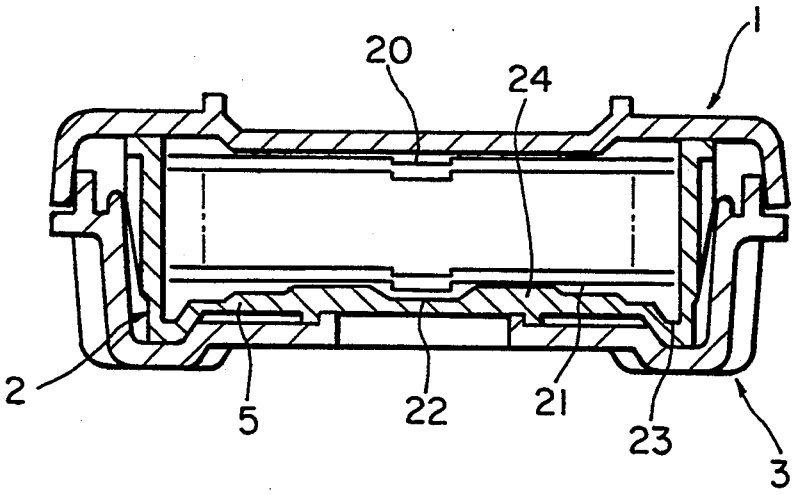
FIG. 5 is a cross sectional view of another embodiment of the inventive box container with the three members as assembled.

FIG. 5 illustrates another embodiment of the inventive box container by a cross sectional view, which is particularly suitable when the sheet bodies 21 such as lead frames to be contained therein each have an island 20. Namely, the base plate 5 of the inner box member 2 is provided with a window or recess 22 at the position corresponding to the island 20 of the sheet bodies 21 so that the risk of damaging the island 20 can be minimized. Further, the base plate 5 of the inner box member 2 is provided with raised steps 24 so that the outer peripheries of the sheet bodies 21 can be prevented from deformation by contacting with the rounded corner portions 23 of the inner box member 2 between the base plate 5 and the side plates 4.

What is claimed is:

1. A box container for holding a plural number of sheet bodies having rigidity which comprises, as an assembly;

(a) an inner box member for holding one or more sheet bodies, one on top of the other;

(b) a box tray member defined by a recessed base plate and raised side wall formed about the said base plate for holding the inner box member when said inner box member is inserted in said box tray member; and (c) a covering member to be mounted on said raised side wall of the box tray member, the inner box member consisting of a generally rectangular base plate and a plural number of side plates each having a bottom portion integrally connected to the bottom line thereof with one of the four sides of the generally rectangular base plate such that, when the inner box member is standing free, each of the side plates forms an angle of inclination outwardly relative to the base plate of said inner box member but is resiliently bendable to take an upright position when each side plate is pushed inwardly so that, when the inner box member is inserted into the box tray member, each of the side plates takes an approximately perpendicular position relative to the base plate of the box tray member.

2. The box container as claimed in claim 1 in which the angle of inclination of each side plate in the inner box member is in the range from 3° to 23°.

3. The box container as claimed in claim 1 in which a wedge-formed rib is provided on the outer surface of each side plate of the inner box member.

4. The box container as claimed in claim 1 in which a horizontal rib is provided on each side plate of the inner box member along the upper periphery thereof.

5. The box container as claimed in claim 1 in which the base plate of the box tray member is provided with at least one window with a frame therearound and the base plate of the inner box member is provided with at least one recess, each recess fits the frame around a corresponding window in the base plate of the box tray member.

6. The box container as claimed in claim 1 in which the covering member is provided on the periphery thereof with at least one hook which comes into engagement with a hook formed on the periphery of the box tray member.

7. The box container as claimed in claim 1 in which the outer surface of the covering member and the outer surface of the base plate of the box tray member are shaped each in a form coming into engagement with the other.

8. The box container as claimed in claim 1 in which at least two side plates are provided on a side of the base plate of the inner box member, each of the side plates being separated from the adjacent side plate by a notch therebetween.

9. The box container as defined in claim 1 in which the covering member further includes a downwardly protruded portion adapted to securely hold sheet bodies in the box container.

* * * * *